US005638919A

United States Patent [19]

Pejout

[11] Patent Number: 5,638,919

[45] Date of Patent: Jun. 17, 1997

[54] ANTI-FALL DEVICE AUTOMATICALLY LOCKABLE ON A SAFETY ROPE

[75] Inventor: Jean Pejout, Bourdeau, France

[73] Assignee: Froment S.A., Genas, France

[21] Appl. No.: 419,945

[22] Filed: Apr. 11, 1995

[30] Foreign Application Priority Data

Apr. 21, 1994 [FR] France ..... 94 05055

[51] Int. Cl.[6] ..... A62B 1/20

[52] U.S. Cl. ..... 182/192; 182/5; 188/65.2; 254/391

[58] Field of Search ..... 182/192, 5; 254/371, 254/408, 409, 415; 188/65.2, 65.1

[56] References Cited

U.S. PATENT DOCUMENTS

| | | | |
|---|---|---|---|
| 3,811,155 | 5/1974 | Stafford | 182/5 X |
| 3,876,036 | 4/1975 | Sweet | 188/65.2 X |
| 4,034,828 | 7/1977 | Rose et al. | 182/5 |
| 4,253,218 | 3/1981 | Gibbs | 188/65.1 X |
| 4,502,668 | 3/1985 | Dodge, Jr. | 254/391 |
| 4,542,884 | 9/1985 | Dodge, Jr. | 254/391 |
| 4,546,851 | 10/1985 | Brennan | 188/65.2 X |
| 4,560,029 | 12/1985 | Dalmaso | 182/192 X |
| 4,657,110 | 4/1987 | Wolner | 182/192 X |
| 4,846,075 | 7/1989 | Tupper | 182/5 X |
| 5,146,655 | 9/1992 | Gibbs | 188/65.2 X |
| 5,156,240 | 10/1992 | Ostrobrod | 188/65.1 |
| 5,265,696 | 11/1993 | Casebolt | 188/65.2 X |
| 5,316,103 | 5/1994 | Bell et al. | 182/5 X |

*Primary Examiner*—Terry Lee Melius
*Assistant Examiner*—Victor Batson
*Attorney, Agent, or Firm*—Dowell & Dowell

[57] ABSTRACT

The invention relates to an anti-fall device automatically lockable on a safety rope, wherein the two cheeks of the gutter comprise a blind notch in L form, opening out on the edge of the corresponding cheek, while the ends of the pivot pin of the two elements of the lever project laterally in order to engage in said notches. The free end of that element of the lever which does not bear the cam is mounted to rotate about a pin sliding in a slideway made on an extension of one of the cheeks of the gutter, this pin being elastically loaded in the direction opposite that of the notches. A pivoting lock borne by one of the cheeks of the gutter is maintained elastically in a position in which it closes the bottom of the notch of the corresponding cheek.

12 Claims, 6 Drawing Sheets

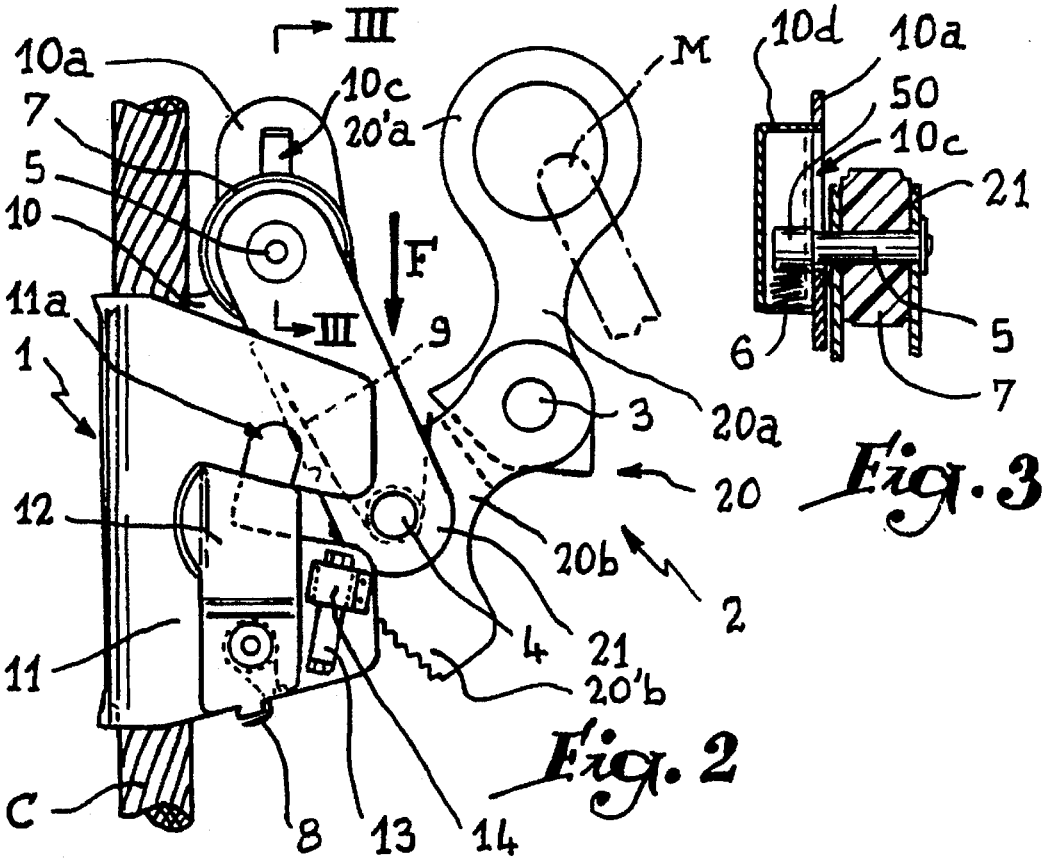
Fig. 2
Fig. 3
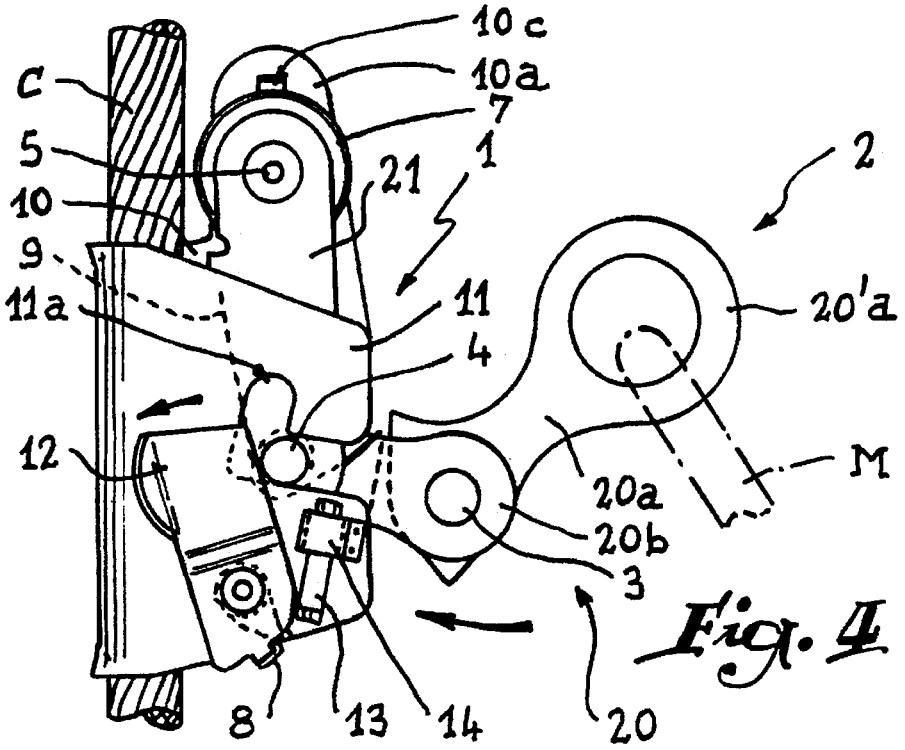
Fig. 4

ANTI-FALL DEVICE AUTOMATICALLY LOCKABLE ON A SAFETY ROPE

FIELD OF THE INVENTION

The present invention relates to improvements in or relating to anti-fall devices connected, on the one hand, to a harness worn by a user and, on the other hand, to a safety rope on which the device automatically locks if the user falls. Such types of devices are well known and are used in particular by building workers. When the worker is moving around, the anti-fall device slides freely with respect to the rope generally oriented vertically and by which he is prevented from falling. The devices in question comprise, of course, means for disconnecting from the safety rope when the user leaves the worksite.

HISTORY OF THE RELATED ART

Such devices are known, generally comprising a rigid gutter-shaped member of U-section, of which one of the cheeks is pivotally associated with one of the arms of a bent pin of which the other arm traverses a lever composed of two elements articulated on each other by means of a hollow pin. When the bent pin is disengaged from notches made in the end part of the cheeks of the gutter and when it is pivoted, it is possible to engage the gutter of the device around a safety rope. Once this operation is effected, the bent pin must be pivoted again so as to bring the articulated lever opposite the opening of the gutter and pivot the latter until its hollow pin comes opposite two holes made in the flanges of the gutter. A pin must then be engaged in the holes and in the hollow pin and the latter automatically locked in place. In the event of fall, a cam pivoting about the hollow pin wedges the device with respect to a rope, preventing the user from falling.

Such a device has numerous drawbacks. Firstly, it is expensive, as it is complex and comprises numerous pieces. In addition, when the user wishes to be sure of his safety, it is necessary to pivot the articulated lever and fold it between the cheeks of the gutter. Furthermore, the two holes of the flanges of the gutter and the hollow pin must be placed perfectly opposite one another so to engage the safety pin, this creating the most serious drawback. It will be readily appreciated that this operation is delicate especially under unfavourable weather conditions.

It is an object of the improvements according to the present invention to overcome these drawbacks and to provide an anti-fall device which is economical and simple to operate.

SUMMARY OF THE INVENTION

The device according to the invention is principally noteworthy in that each of the two cheeks of the gutter comprises a blind or closed notch in L form, opening out on the edge of the corresponding cheek. The ends of a pivot pin of the two elements of the lever project laterally in order to engage in the notches. The free end of that element of the lever which does not bear the cam is mounted to rotate about a pin sliding in a slideway made on an extension of one of the cheeks of the gutter. The pin is elastically loaded in the direction opposite that of the notches; and a pivoting lock carried by one of the cheeks of the gutter is maintained elastically in a position in which it closes the bottom of the notch of the corresponding cheek.

BRIEF DESCRIPTION OF THE DRAWINGS

The invention will be more readily understood on reading the following description with reference to the accompanying drawings, in which:

FIG. 2 shows how the articulated lever is folded before it is fastened to a safety rope.

FIG. 3 is a section along III—III (FIG. 2).

FIG. 4 is a view similar to that of FIG. 2, but illustrating the last phase of positioning the device according to the invention.

DESCRIPTION OF PREFERRED EMBODIMENT

Figure 1:
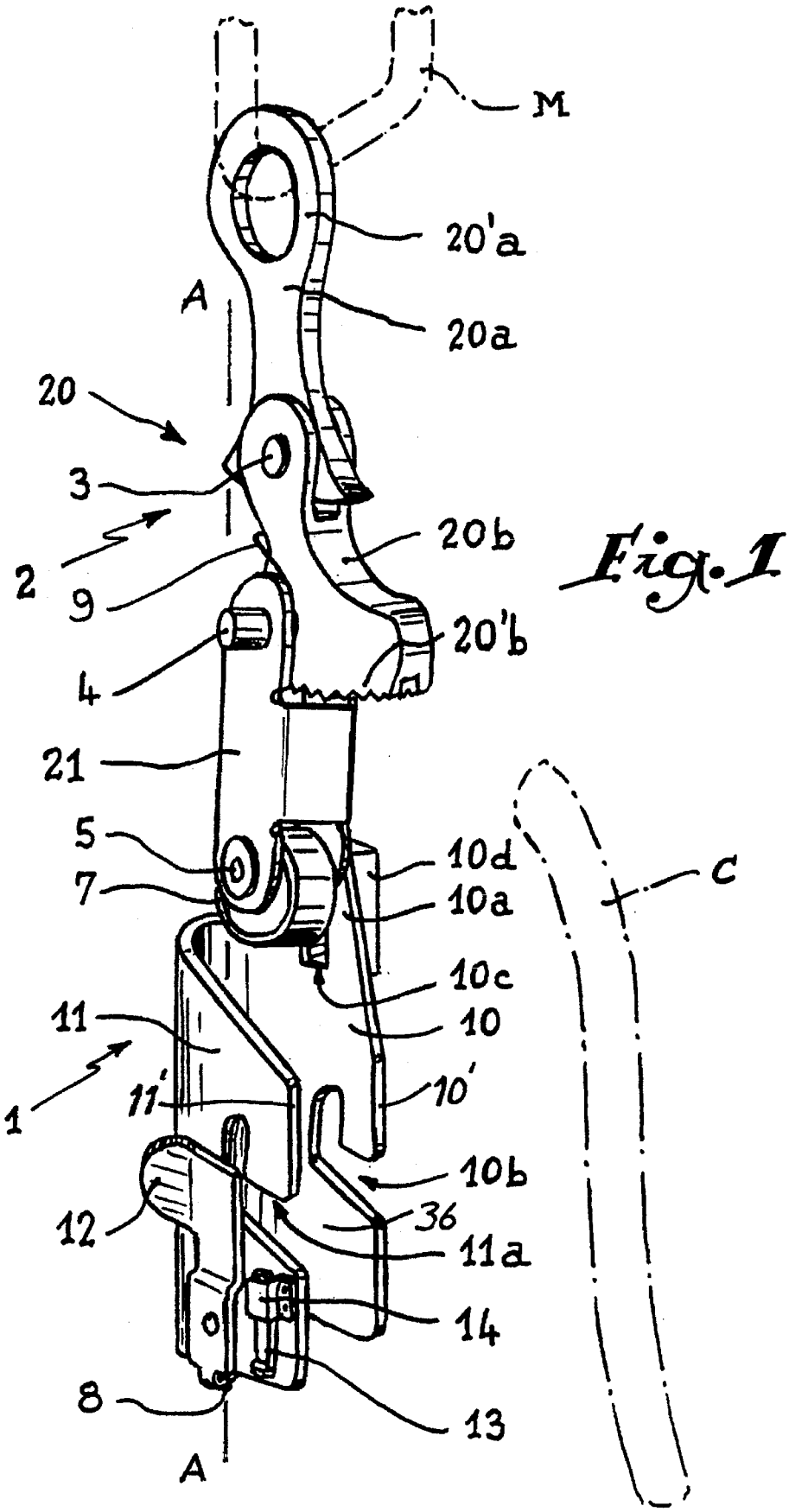
FIG. 1 is a view in perspective of the device according to the invention, in open state.

Referring now to the drawings, the anti-fall device according to the invention essentially comprises, as illustrated in particular in FIG. 1, a gutter element or bracket 1 with cross-section in the form of a U with rounded bottom, of which the cheeks 10, 11 are parallel and a composite lever 2 mounted to rotate with respect to an extension 10*a* of the cheek 10, as will be more readily explained hereinafter.

Each cheek 10, 11 is provided with an L-shaped notch referenced 10*b* and 11*a* respectively. The two notches in question are located exactly opposite each other. Each notch comprises an oblique slot opening out on the free edge 10' and 11' of each corresponding cheek and a blind or closed slot roughly parallel to the free edges.

The extension 10*a* of the cheek 10 comprises a slot 10*c* parallel to the geometrical A—A of the gutter 1. The lever 2 comprises a first element 20 represented in two parts 20*a*, 20*b* but which might be one-piece. In the embodiment shown, the two parts 20*a* and 20*b* are articulated about a pin 3. The free end of part 20*a* comprises a ring 20'*a* while the free end of part 20*b* includes a cam with toothed surface 20'*b*. The two parts 20*a*, 20*b* are provided with bearing faces oblique with respect to one another and which allow a certain angular clearance of such parts.

The second element 21 of the lever 2 is in the form of a fork joint in one of the ends of which is engaged part 20*b* of the first element 20. A pin 4 traverses the element 21 and part 20*b* so that these two elements are articulated to one another. It will be observed that the pin 4 projects laterally outside each of the wings or flanges 21*a* of element 21.

The other end of this element 21 is articulated about a pin 5 which traverses the slot 10*c* and has a head 50 outside cheek 10 (FIG. 3). This head is surrounded by a box 10*d* fixed outside the cheek in question. In the box is placed a spring 6 which elastically loads or urges the pin 5 in the direction of the end of the extension 10*a* of the cheek 10.

A roller 7 is mounted to rotate about pin 5.

A lock 12 is pivotally mounted with respect to the cheek 11 of the gutter 1 and it is loaded by a torsion spring 8 so that, in free position, it is maintained in the position of FIG. 1, i.e. it closes the blind slot of notch 11*a*.

On the outer face of one of the cheeks 10 or 11 there is placed a finger 13 sliding freely in a flange 14. The two ends of the finger 13 comprise a thickened part maintaining it captive in the flange 14.

It will be observed that a torsion spring 9 is mounted about pin 4 so as to urge part 20*b* of the first element 20 of lever 2 in clockwise direction, for reasons which will be explained hereinbelow.

Functioning will follow from the foregoing.

The user of the device according to the invention begins by hooking a snap M or other hook in the ring 20'*a*. He passes the device around the vertical safety rope C which passes into the opening 36 between the cheeks 10, 11 of the gutter bracket, and penetrates between the roller 7 and the bottom 1*a* of the gutter 1 so that this bottom cooperates over the whole of its length with rope C.

As illustrated in FIG. 2, he pivots the lever 2 freely so that the cam 20'*b* penetrates between the cheeks of the gutter. The operator then presses on the second element 21 in the direction of arrow F to slide pin 5 in slot 10*c* so that the laterally projecting ends of pin 4 then come to the end of the opening of the two notches 10*b*, 11*a*. Spring 9 maintains part 20*b* loaded or resiliently urged in clockwise direction, i.e. cam 20'*b* is maintained slightly in abutment against rope C.

It is observed that the finger 13 is retracted with respect to the opening of the notch 11*a* as the device is suitably oriented.

The following operation consists in subjecting element 21 of the lever 2 to a rotation about its pin 5 while maintaining it in the direction of gutter 1, with the result that pin 4 penetrates in the oblique slot of the two notches, provoking tipping of the lock 12 towards the left (FIG. 4).

Figure 5:
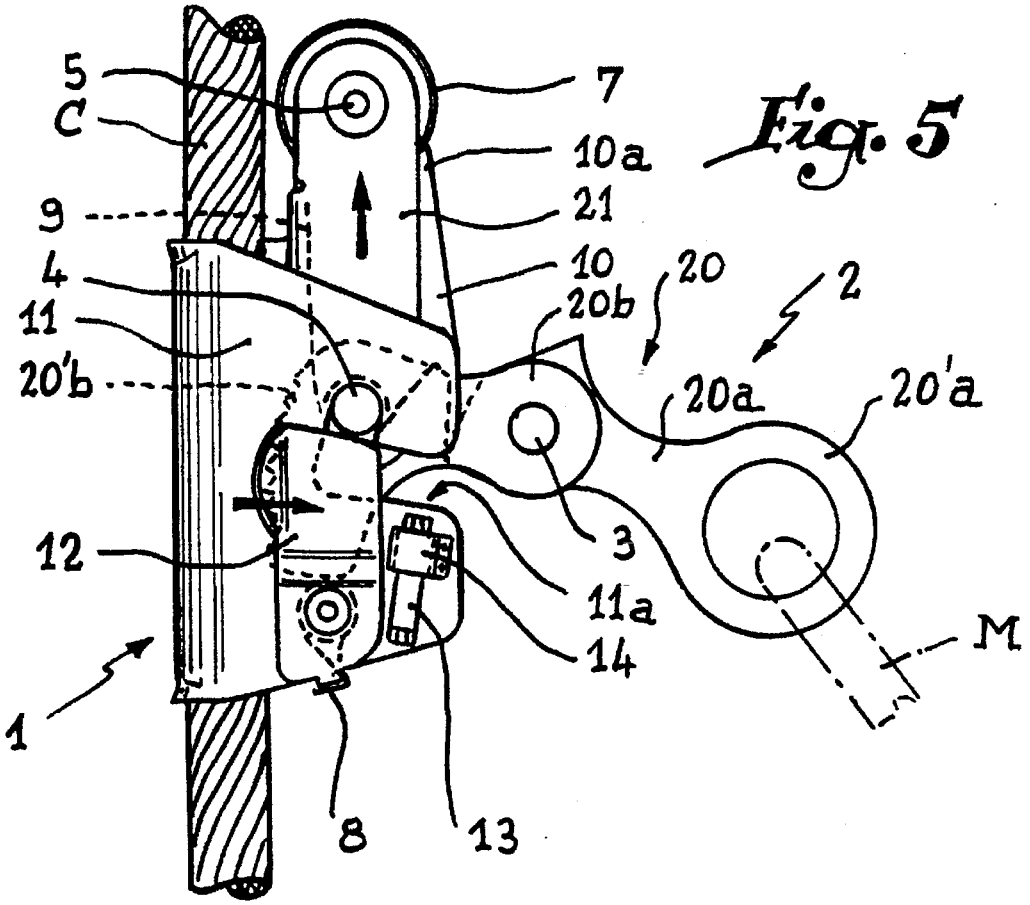
FIG. 5 shows the device in operational position.

By continuing the movement, the position of FIG. 5 is attained, in which the ends of pin 4 come against the bottom or base of the blind slots of the notches, releasing the lock 12, which pivots counterclockwise as shown by the arrow in FIG. 5, and blocks said pin 4 against the bottom or base.

Figure 6:
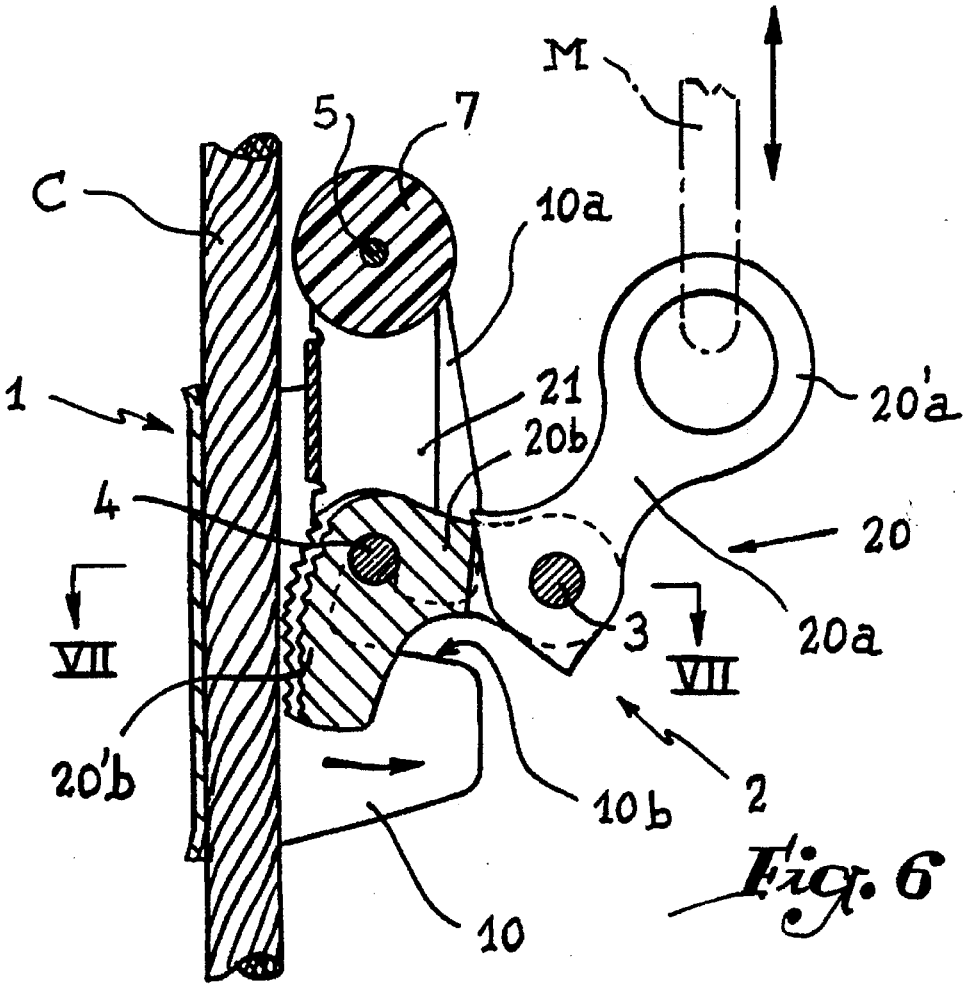
FIG. 6 is a longitudinal section corresponding to FIG. 5.
Figure 7:
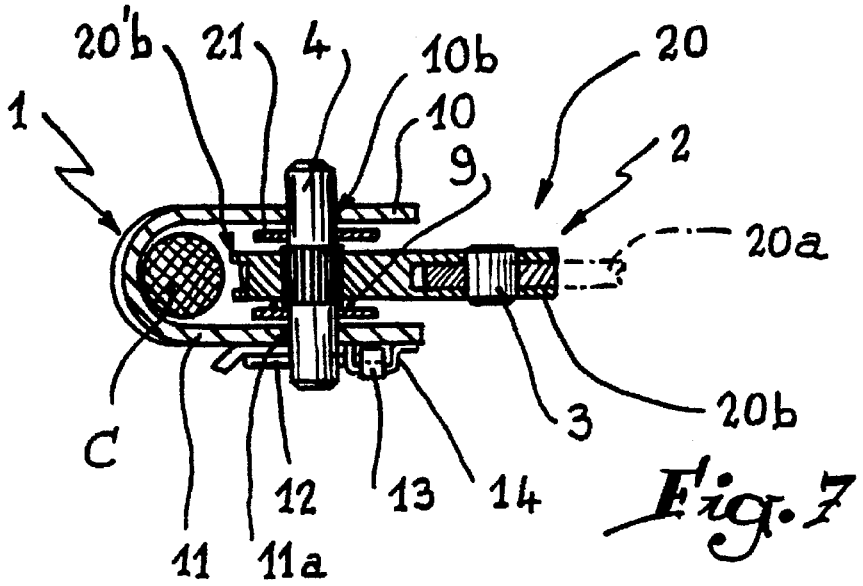
FIG. 7 is a section along VII—VII (FIG. 6).
Figure 8:
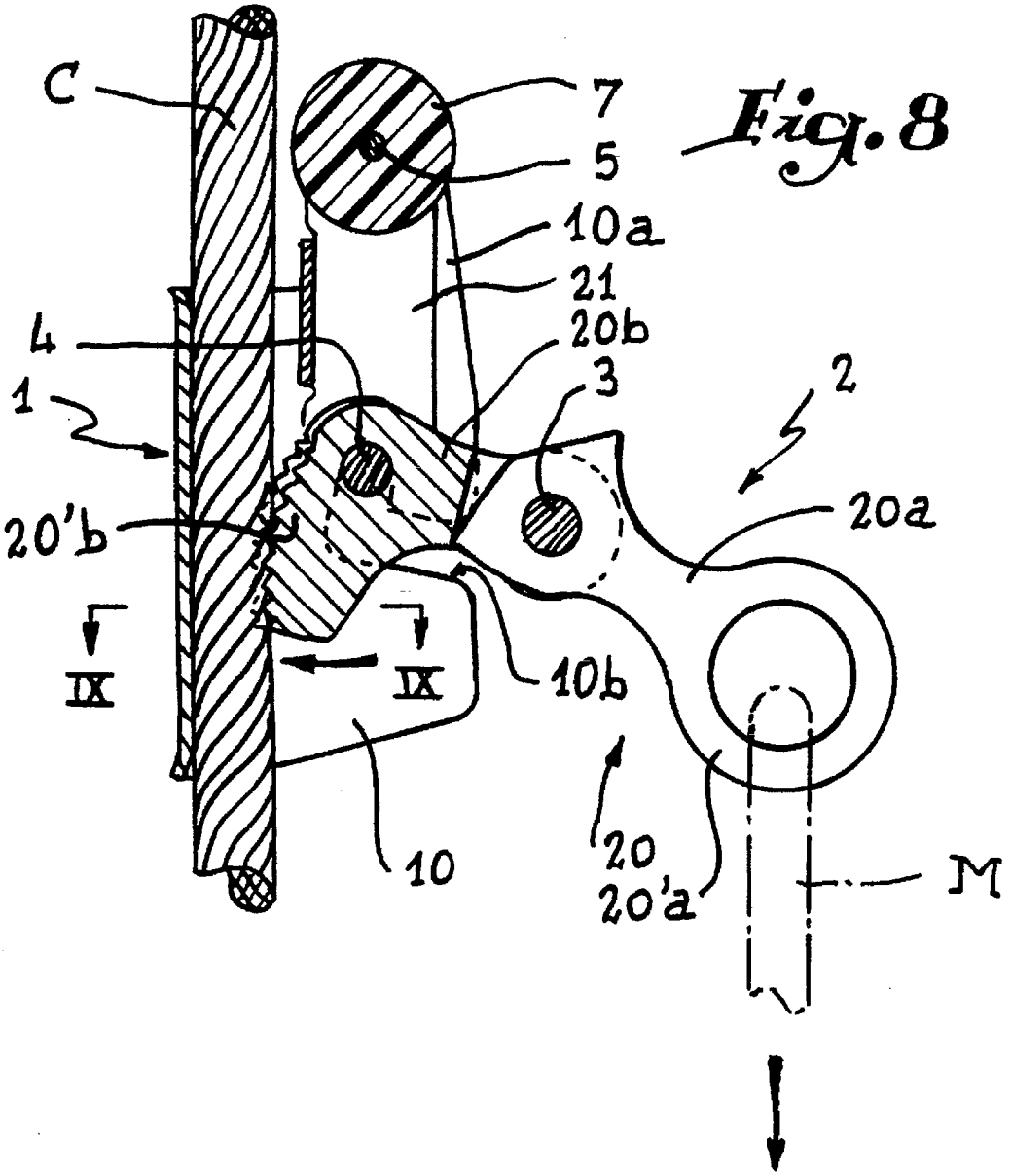
FIG. 8 is a view similar to that of FIG. 6, but showing the device according to the invention locked with respect to the safety rope.

In this position, the cam 20'*b* is not in contact with the rope C, as illustrated in FIG. 6, with the result that the user may climb and descend without the device according to the invention being wedged with respect to the rope. In FIGS. 6 and 7, it is observed that part 20*a* of element 20 of the lever is free to move at a certain angle to avoid any untimely wedging of the cam with respect to the rope in the user's normal position of work.

Figure 9:
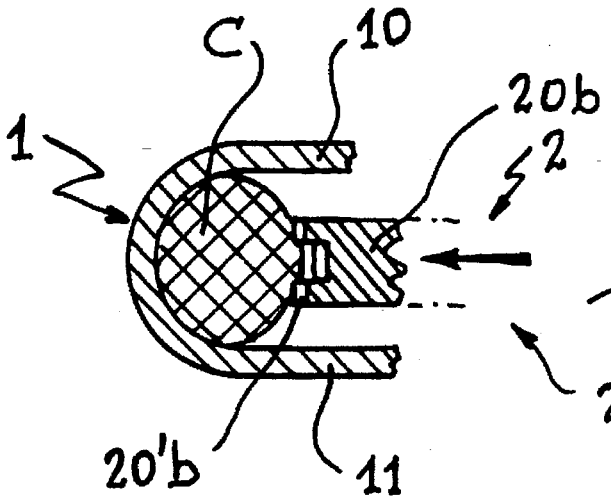
FIG. 9 is a section along IX—IX (FIG. 8) on a larger scale.

In the event of a fall, the snap M acts brutally downwardly on part 20*a* of element 20 of lever 2 which pivots about its pin 3 and acts in the same manner on part 20*b* of said element 20 in order to apply cam 20'*b* firmly against the rope C (FIG. 9). Of course, the device slides very slightly downwardly along the rope before the user, having fallen, is finally immobilized.

Figure 10:
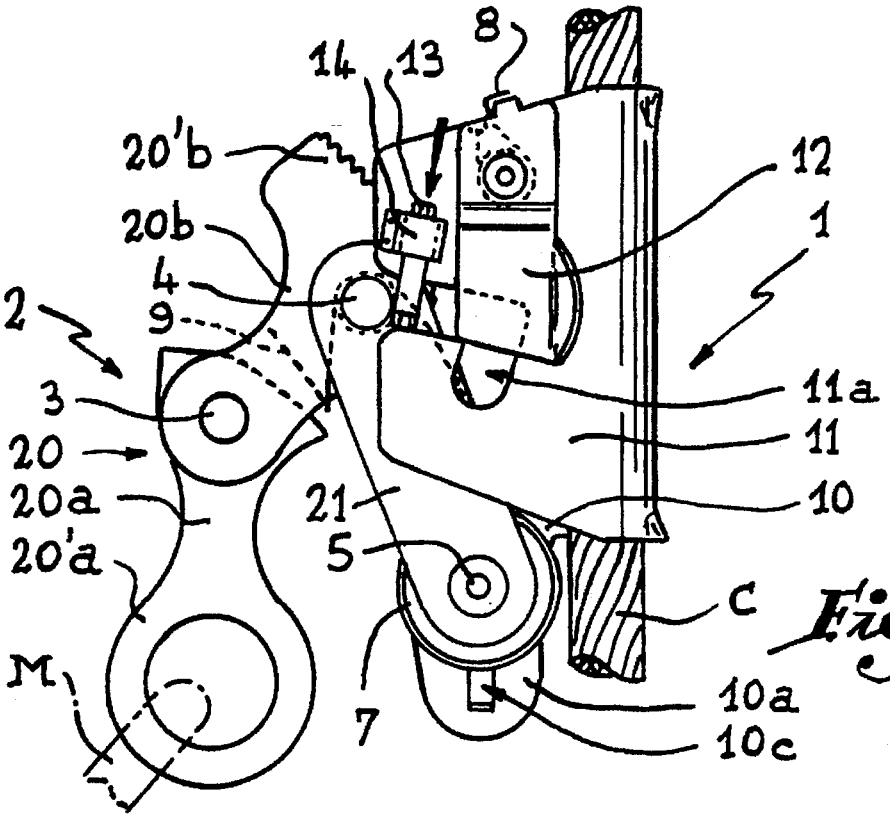
FIG. 10 illustrates the manner in which a finger closes the opening of the notch of one of the cheeks when the device is presented head-down.
Figure 11:
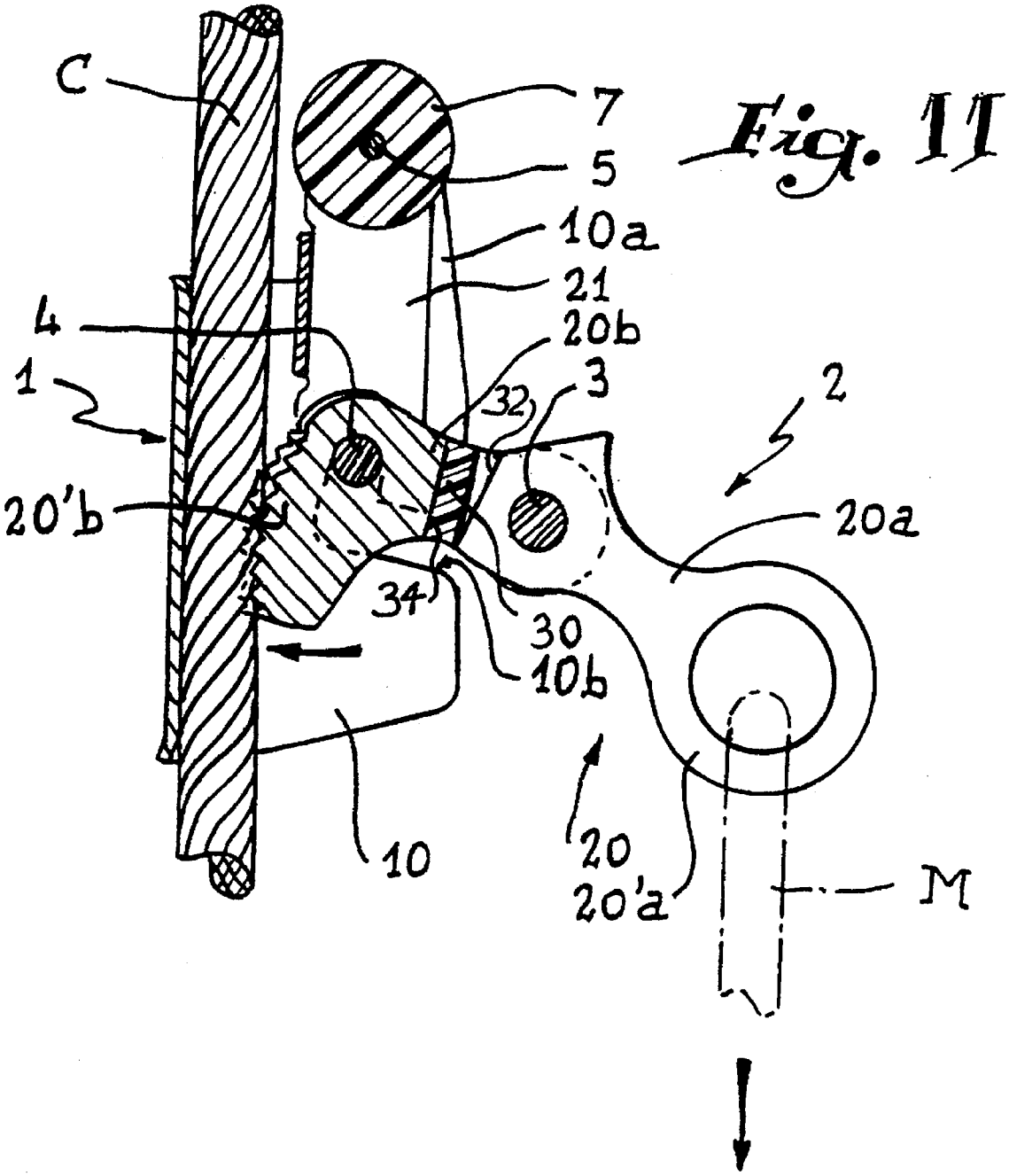
FIG. 11 is a view similar to that of FIG. 8, but showing a second embodiment of the invention.

It is observed in FIG. 10 that, if the user engages the device according to the invention with respect to the rope C upside-down, the finger 13 moves by gravity in front of the opening of the corresponding notch of the gutter 1 so that it is impossible to position pin 4 in the notches. It might be provided to place a damper such as a block of natural or synthetic rubber between the two bearing faces of parts 20*a* and 20*b* of element 20 of lever 2 in order to dampen somewhat the shock transmitted on the harness if the user falls. As shown in the second embodiment of the invention, in FIG. 11, a damper 30, such as a block of natural or synthetic rubber may be placed between the two bearing faces 32 and 34 of the parts 20*a* and 20*b*.

What is claimed is:

1. A safety device for use in securing a harness to a rope-like object comprising, a generally U-shaped gutter bracket having a bottom defined between opposing cheeks each of which extends from said bottom to a free edge, an elongated opening defined between said free edges of said cheeks, a lever having first and second elements which are articulated to one another about a first pivot means, said second element being pivotally connected relative to said cheeks of said gutter bracket about a second pivot means which is moveable relative to said cheeks in a slideway extending along one of said cheeks, said first element having one end adjacent said first pivot means defining a cam and a second end adapted to be engaged by a harness, a generally L-shaped notch in each of said cheeks of said gutter bracket, each L-shaped notch having a first slot opening to an adjacent free edge of said cheeks and a second slot extending generally toward second pivot means, a pivotable lock mounted to one of said cheeks and moveable between a first locking position closing said second slot of said L-shaped notch to an open position wherein said pivotable lock is spaced from said L-shaped notch, said first pivot means having end portions extending outwardly with respect to said first and second elements of said lever so as to be selectively engageable with said L-shaped notches of said cheeks of said gutter bracket when said lever is pivoted from a first open position in which said lever does not obstruct the opening between said cheeks of said gutter bracket, thereby allowing the rope-like object to be inserted therebetween, to a second end position wherein said first pivot means is engaged within said L-shaped notches with said cam positioned so as to be engageable against the rope-like object extending between said cheeks and against said bottom of the gutter bracket, and first resilient means for urging said second pivot means away from said L-shaped notches to thereof urge said first pivot means toward a seated engagement within said second slots of said L-shaped notches when said first pivot means is in said second position, whereby when said first pivot means is within said second slots of said L-shaped notches said pivotable lock moves to said first locking position to retain said second pivot means within said second slots.

2. The safety device of claim 1 including a slidable finger element mounted to one of said cheeks of said gutter bracket adjacent said L-shaped notch therein, said finger element being moveable by gravity from a first position spaced from said L-shaped notch therein to a second position obstructing said first slot of said L-shaped notch therein when the device is oriented with said second slots below said first slots of said L-shaped notches.

3. The safety device of claim 1 including a second resilient means for normally urging said first element of said lever into general alignment with said second element of said lever.

4. The safety device of claim 3 wherein said cam of said first element of said lever engages said second element of said lever when said first element is generally aligned with said second element.

5. The safety device of claim 4 wherein said second resilient means includes a torsion spring extending about said first pivot means.

6. The safety device of claim 3 wherein said first element of said lever includes first and second parts which are pivoted to one another, and each of said first and second parts having opposing bearing faces.

7. The safety device of claim 6 including a damper disposed between said bearing faces of said first and second parts of said first element of said lever.

8. The safety device of claim 6 including a roller mounted about said second pivot means thereby facilitating the placement of the rope-like object between said cheeks of said gutter bracket.

9. The safety device of claim 8 wherein said slideway includes a slotted opening in said one of said cheeks, a housing extending over said slotted opening, said first resilient means being mounted within said housing and engaging said second pivot means.

10. The safety device of claim 9 including a slidable finger element mounted to one of said cheeks of said gutter bracket adjacent said L-shaped notch therein, said finger element being moveable by gravity from a first position spaced from said L-shaped notch therein to a second position obstructing said first slot of said L-shaped notch therein when the device is oriented with said second slots below said first slots of said L-shaped notches.

11. The safety device of claim 1 wherein said first element of said lever includes first and second parts which are pivoted to one another, and each of said first and second parts having opposing bearing faces.

12. The safety device of claim 11 including a slidable finger element mounted to one of said cheeks of said gutter bracket adjacent said L-shaped notch therein, said finger element being moveable by gravity from a first position spaced from said L-shaped notch therein to a second position obstructing said first slot of said L-shaped notch therein when the device is oriented with said second slots below said first slots of said L-shaped notches.

* * * * *